US007635017B2

(12) United States Patent
Bennett, III et al.

(10) Patent No.: US 7,635,017 B2
(45) Date of Patent: Dec. 22, 2009

(54) SECTIONAL DOOR CABLE TENSIONER

(75) Inventors: Thomas B. Bennett, III, Wooster, OH (US); Dwayne J. Kornish, Navarre, OH (US); Edward C. Johnston, Dalton, OH (US)

(73) Assignee: Wayne-Dalton Corp., Mt. Hope, OH (US)

( * ) Notice: Subject to any disclaimer, the term of this patent is extended or adjusted under 35 U.S.C. 154(b) by 925 days.

(21) Appl. No.: 11/248,979

(22) Filed: Oct. 11, 2005

(65) Prior Publication Data

US 2006/0027343 A1 Feb. 9, 2006

Related U.S. Application Data

(63) Continuation of application No. 10/465,318, filed on Jun. 19, 2003, now abandoned.

(51) Int. Cl.
*E05D 15/26* (2006.01)

(52) U.S. Cl. ..... 160/201; 49/322

(58) Field of Classification Search ..... 160/201, 160/206, 207, 213, 191, 192, 193; 49/322
See application file for complete search history.

(56) References Cited

U.S. PATENT DOCUMENTS

| | | | | |
|---|---|---|---|---|
| 3,160,200 | A | 12/1964 | McKee et al | 160/189 |
| 3,412,780 | A | 11/1968 | Moler | 160/191 |
| 4,736,826 | A | 4/1988 | White et al. | 191/12.2 A |
| 4,871,007 | A | 10/1989 | Abolins | 160/201 |
| 4,892,262 | A | 1/1990 | Hurst | 242/157.1 |
| 5,280,879 | A | 1/1994 | Kreuter | 254/333 |
| 6,145,570 | A | 11/2000 | Mullet et al. | 160/191 |
| 6,164,014 | A | 12/2000 | McDowell et al. | 49/200 |
| 6,189,266 | B1 | 2/2001 | Mihalcheon | 49/322 |
| 6,263,947 | B1 | 7/2001 | Mullet | 160/191 |

FOREIGN PATENT DOCUMENTS

| | | |
|---|---|---|
| FR | 2 805 305 | 8/2001 |
| WO | WO 96/38644 | 12/1996 |

*Primary Examiner*—David Purol
(74) *Attorney, Agent, or Firm*—Renner Kenner Greive Bobak Taylor & Weber

(57) ABSTRACT

A cable tensioner (20) for a sectional overhead door (D) having a motor-driven counterbalance system (30) including, a spring-loaded axle (31), cable drums (24) carried by the axle, cables (C) attached to and interconnecting the cable drums and the door and forming and releasing cable wraps (29) on the cable drums upon raising and lowering of the door, the cable tensioner having, a tension spring (31) adapted to be mounted on the sectional door having a first end (34) and a second end (35), the first end being adapted to engage the door and the second end being adapted to slidingly engage the cable, wherein the tension spring urges the second end to take up any slack in the cable.

14 Claims, 7 Drawing Sheets

SECTIONAL DOOR CABLE TENSIONER

CROSS-REFERENCE TO RELATED APPLICATIONS

This application is a continuation of U.S. Ser. No. 10/465,318 filed Jun. 19, 2003 now abandoned.

TECHNICAL FIELD

In general, the present invention relates to upwardly acting sectional doors. More particularly, the present invention relates to an upwardly acting sectional door system employing a motor-driven counterbalance system having a shaft, a torsional spring and cable to counterbalance the weight of the door. Most particularly, the present invention relates to a cable tensioner for maintaining the proper tension on the cable of such a door system.

BACKGROUND ART

Counterbalancing systems for sectional overhead doors have commonly employed torsion spring arrangements. The use of torsion springs in such sectional overhead doors is, in significant part, because the linear tension characteristics of a torsion spring can be closely matched to the substantially linear effective door weight as a sectional door moves from the open, horizontal position, where the door is largely track supported, to the closed, vertical position or vice versa. In this manner, the sum of the forces acting on such a sectional garage door may be maintained relatively small except for momentum forces generated by movement of the door by the application of manual or mechanical forces. In this respect, sectional overhead doors have been provided with lift cables or similar flexible elements attached to the bottom of the door and to cable storage drums mounted in spaced relation on a drive tube, which rotate when the drive tube is actuated.

In many cases, these cable storage drums have surface grooves that guide the lift cables on and off of the cable storage drum to prevent the coils or cable wraps from rubbing against each other and chafing which would occur if positioned in side-by-side engaging relationship or if coiled on top of each other. Lift cables sized to meet operational requirements for sectional overhead door applications are commonly constructed of multiple strand steel filaments that have a pronounced resistance to bending when stored on the circumference of the cable drums and, thus, require tension to remain systematically coiled or wrapped about the cable drums in the surface grooves therein.

A problem arises if tension is removed from one or both of the lift cables of a sectional overhead door in that the lift cables tend to unwrap or separate from the cable drums; thereafter, when tension is restored, the lift cables may not relocate in the appropriate grooves or in appropriate relation to adjacent cable wraps. In some instances, a cable wrap will locate on a groove further axially inboard of the door from its original position so that as the door moves to the fully opened position, the cable drum runs out of grooves for cable wraps, such that the lift cable coils about parts of the drum that are not designed for cable storage. In this instance, if the lift cable dislodges from the cable storage drum and engage the smaller radius of the counterbalance system drive tube, the leverage affected by the springs through the cable drum and cable is reduced such that the door will be extremely difficult or impossible to move. This is because the linear force between the door and the counterbalance springs relies on the leverage against the counterbalance spring being applied by the weight of the door operating through the radius of the cable storage drum grooves rather than a reduced radius portion of the cable drum or the drive tube for the counterbalance system In other instances, the removal of tension from the lift cables can result in cable wraps or coils being axially displaced from the proper groove on the cable drum to overlie existing cable wraps stored on the cable drum, which may cause the length of cable between the cable drums at opposite ends of a door to assume a different effective operating length. In such case, the door may be shifted angularly in the door opening, with the bottom edge of the door no longer paralleling the ground and the ends of the door sections moving out of a perpendicular orientation to the ground. When thus angularly oriented, continued movement of the door can readily result in the door binding or jamming in the track system and, thus, being rendered inoperative.

In the instance of either of these operating anomalies occasioned by loss of tension in the lift cables, it is probable that the resultant tangling of the lift cables and/or jamming of the doors will prevent the door from further automatic or manual operation, leave the door in a partially open condition, and require qualified service personnel to repair or replace damaged components and reassemble and realign the door and counterbalance system components before the door is restored to normal operating condition.

There are a number of possible operating circumstances wherein tension in the lift cables of a counterbalance system for a sectional overhead door becomes reduced to such an extent that the lift cables may become mispositioned on or relative to the cable storage drums, thereby producing the problems discussed above. One example is when a door is rapidly raised from the closed to the open position at a velocity that is faster than the cable storage drums can rotationally react, such that slack is created in the lift cables. Another example is in the utilization of a motorized unit, such as a jackshaft type operator, that turns the counterbalance system shaft to open and close a sectional overhead door. A jack-shaft may create cable slack when the operator turns the cable storage drums without the door moving. Many jackshaft operators have motor controls and sensors that will determine if the operator is turning the counterbalance tube without the door moving to minimize cable slack which will result in the cables becoming entangled. However these methods are not exact nor are they instantaneous such that the operator could rotate the drive tube and cable drums through one or more revolutions before the sensors signal the motor controls to shut the motor off. During this time the cable is slack and if this occurs when the door is in the fully open position, the cables can become tangled preventing further movement of the door.

One approach to preventing cable mispositioning has involved utilization of grooves in the circumference of the cable storage drums, which are otherwise present for positioning and spacing cable as it is taken up during the raising of a garage door. In some instances, exaggerated or deep grooves have been employed in the cable storage drums in an effort to maintain the lift cables appropriately positioned during a loss of tension on the lift cables. While the use of grooves so configured may be helpful in preventing lift cable mispositioning in minor losses of tension, this approach does not solve the commonly encountered problem of appreciable slack being created in the lift cables.

Another approach to preventing cable mispositioning has involved utilization of retainers in the form of a hood, shroud or snubber associated with the cable drums. With these devices capturing the cable between the drum and the retainer, the proper cable positioning can be maintained for a particular size drum and system components. However, these retainers do not permit utilization on other than a particular one of the many different drum sizes and configurations employed by different manufactures for different door systems.

Thus, no solution to substantial cable slack in sectional overhead door systems having motor driven counterbalance systems, for cable drums of different designs and sizes, has been recognized in the industry.

DISCLOSURE OF THE INVENTION

Therefore, an object of the present invention is to provide a cable tensioner for a motor driven counterbalance system for a sectional overhead door that accommodates slack developed in a lift cable without attendant mispositioning of the lift cable on the cable storage drums when tension in the lift cables is restored. Another object of the present invention is to provide such a cable tensioner which is operative independent of the style, shape, or size of the cable storage drums of the counterbalance system of the door. A further object of the present invention is to provide such a cable tensioner wherein cable tension and thus, cable positioning on the cable drums, is maintained even in the event of the development of several feet of slack in the cable due to the cable drums being driven without attendant movement of the door.

Another object of the present invention is to provide a cable tensioner for a motor driven counterbalance system for a sectional overhead door which consists of springs, a cable engaging clip and mounting brackets for positioning the springs on the door. Yet another object of the invention is to provide such a cable tensioner that does not mount over or adjacent to the cable storage drums and does not require pulleys or other components to manage even substantial amounts of cable slack. Still a further object of the invention is to provide such a cable tensioner that employs a flexible wand, which may be formed unitary with the spring, that can deflect to maintain cable alignment with the cable drum grooves even when substantial slack is being taken up by the tensioner when the door is in the fully open position.

Still another object of the present invention is to provide a cable tensioner for a motor driven counterbalance system for a sectional overhead door that may employ cable storage drums having conventional guide grooves. A still further object of the present invention is to provide such a cable tensioner that does not affect the counterbalance system or alter its operational performance in a manner that could produce adverse effects on the operation of the door. A still further object of the present invention is to provide such a cable tensioner which mounts to the lower panel of the door and therefore does not require a ladder or special tools to install. A still further object of the present invention is to provide such a cable tensioner that is relatively inexpensive, requires no service, and can readily be retrofitted to existing motor driven counterbalance systems.

In general, the present invention contemplates a cable tensioner for a sectional overhead door having a motor-driven counterbalance system including, a spring-loaded axle, cable drums carried by the axle, cables attached to and interconnecting the cable drums and the door and forming and releasing cable wraps on the cable drums upon raising and lowering of the door, the cable tensioner having, a tension spring adapted to be mounted on the sectional door having a first end and a second end, the first end being adapted to engage the door and the second end being adapted to slidingly engage the cable, wherein the tension spring urges the second end to take up any slack in the cable.

BEST MODE FOR CARRYING OUT THE INVENTION

Figure 3:
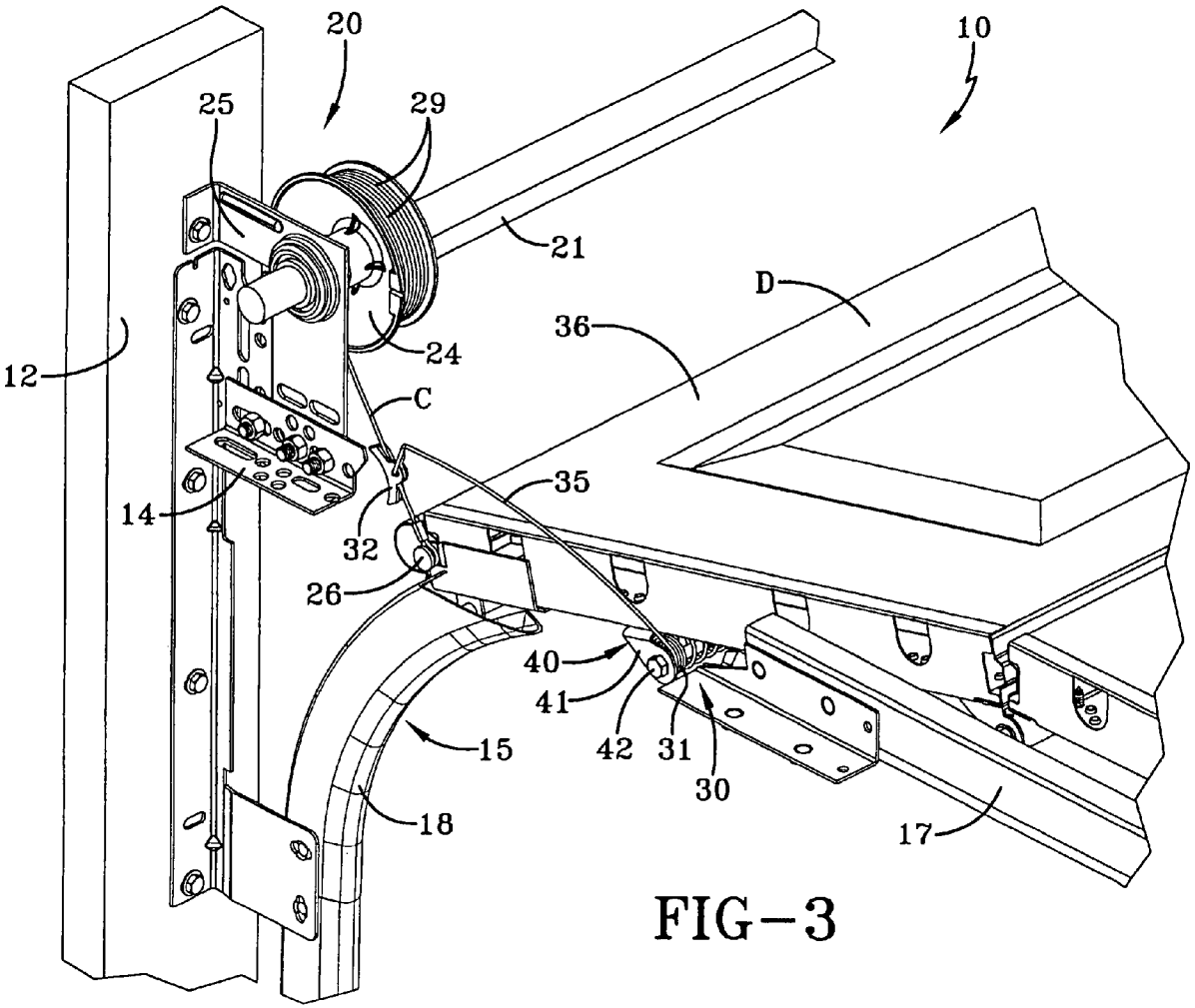
FIG. 3 is an enlarged perspective view of the lower corner of the door of FIG. 1 depicting details of the positioning of cable tensioner when the door is in an open position.

A door system, generally indicated by the numeral 10, is shown in the accompanying drawings. Door system 10 generally includes an upwardly acting door D, such as a rolling door or a sectional door, as shown. Door system 10 is located within an opening defined by a framework 11 which may include a pair of vertically oriented jambs 12 that are horizontally spaced from each other and connected by a header 13 near their upper vertical extremity. Track assemblies, generally indicated by the numeral 15, may be supported on the framework 11, as by flag angles 14 that extend rearwardly from the jambs 12. Track assemblies 15 may include a generally vertical track section 16 and a generally horizontal track section 17 interconnected by an arcuate transition section 18. The track assemblies 15 may include channel-like track sections 16, 17, 18 that receive guide rollers 19 mounted on the door D. The rollers 19 and track assemblies 15 interact to guide the door from a generally vertical closed position (FIG. 1) to a generally horizontal open position (FIG. 3).

Figure 4:
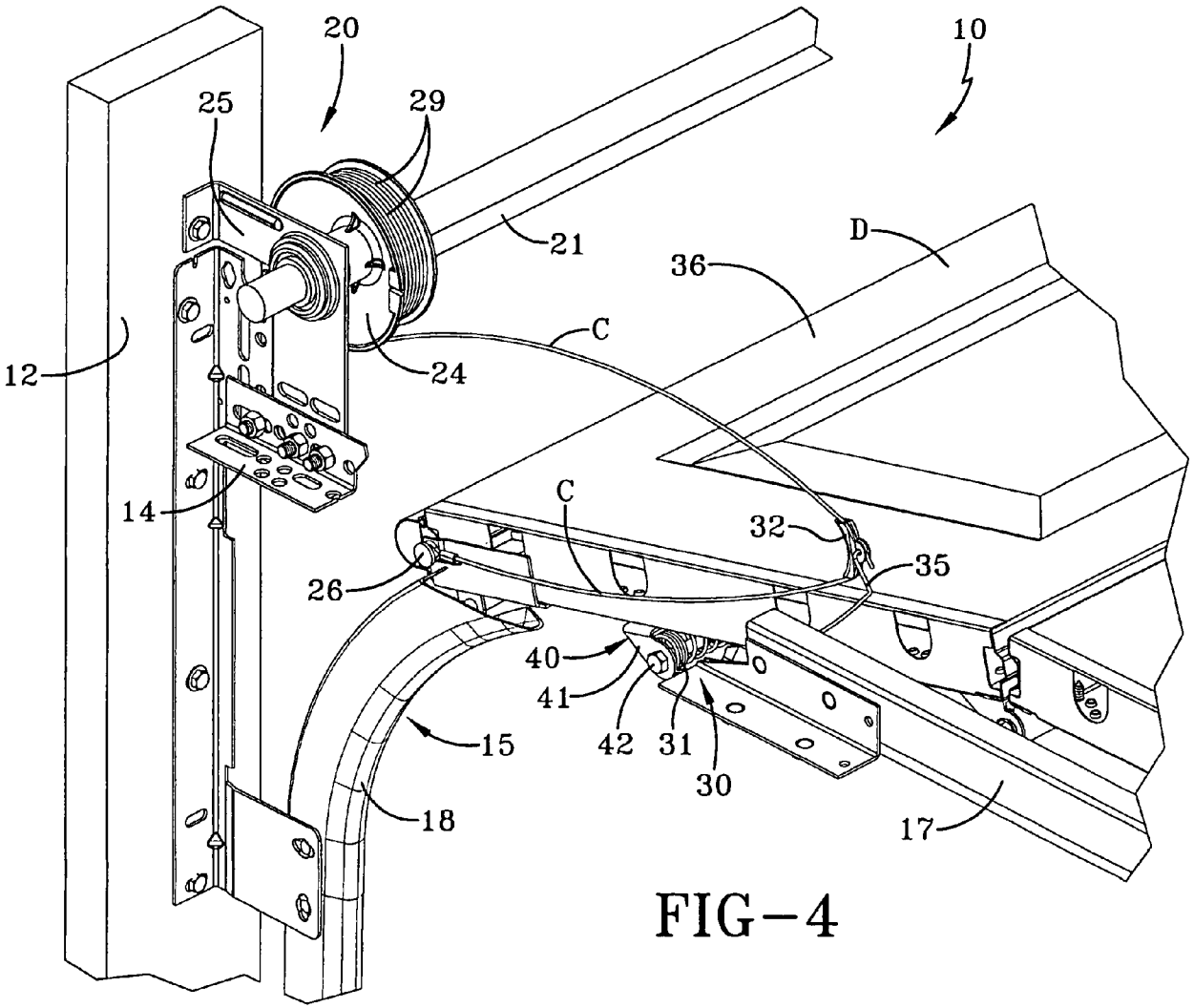
FIG. 4 is an enlarged rear perspective view similar to FIG. 3, depicting the positioning of the cable tensioner when taking up slack in the cable.

To aid in the lifting of the door D, a counterbalance assembly, generally indicated by the numeral 20, is provided. The counterbalance assembly 20 generally includes an axle 21, a counterbalance spring 22, which may be a coil spring 30, as shown, and a cable C (FIG. 3), which may be windingly received on a cable drum 24 located at either end of the axle 21. The axle 21 is supported by a support bracket 25 and freely rotatable therein. In turn, the cable drum 24 is rotatably fixed to the axle 21, such that it rotates therewith to wind and unwind the cable C to raise and lower the door D. The opposite end of the cable C is attached to the door D, as by a lug 26 extending from an edge 27 of the door D. As best shown in FIG. 4, the lug 26 may be located at the approximate lower extremity of the door D. It will be appreciated that cables C are located at both ends of the door D, but for sake of simplicity, the description will proceed with reference to a single cable C.

Figure 1:
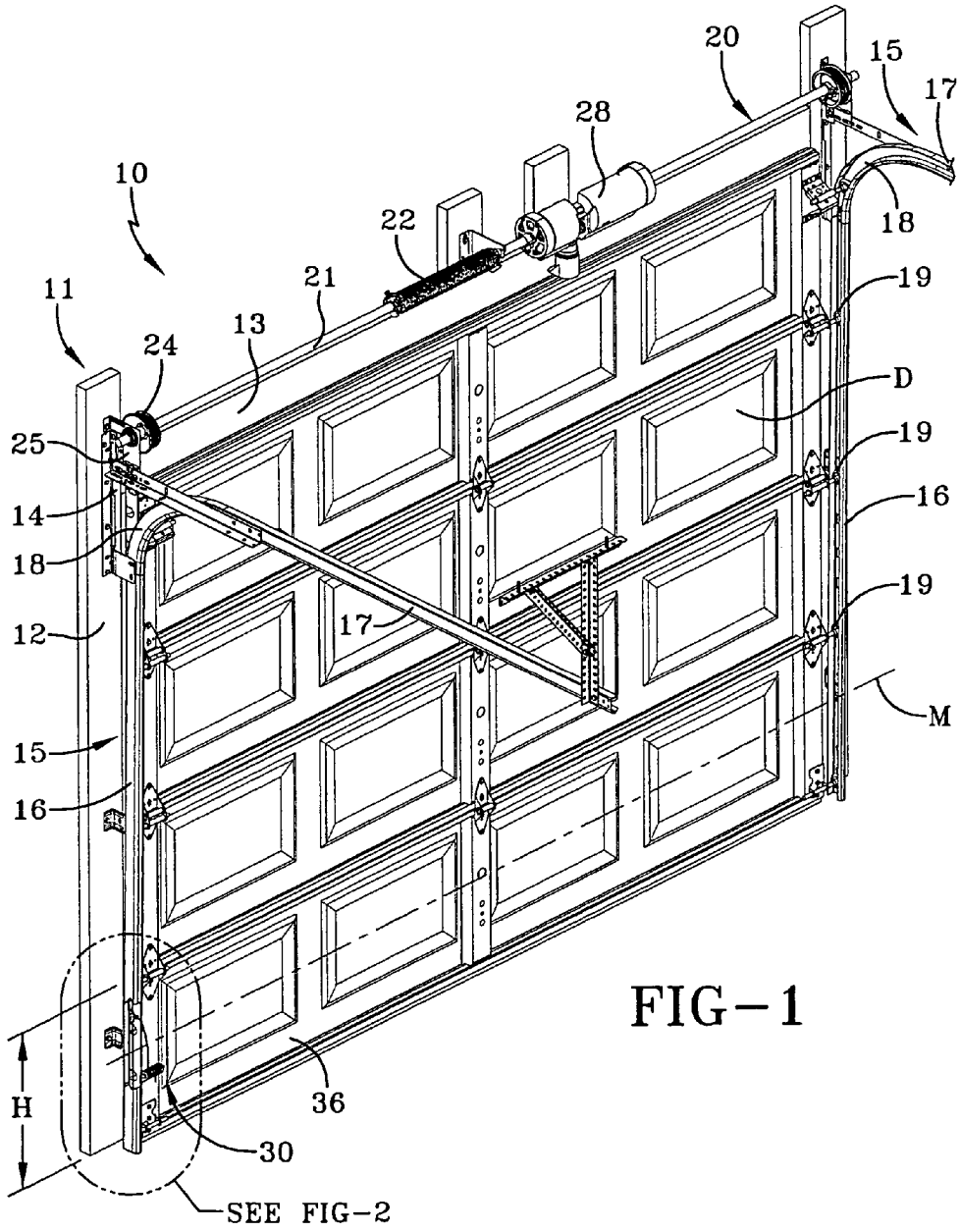
FIG. 1 is a rear perspective view of a door system including an upwardly acting sectional door having a plurality of segments mounted on a pair of tracks, a motor-driven counterbalance assembly including a torsion spring, cable drums and a cable attached to the door, and a cable tensioner according to the concepts of the present inventions.
Figure 2:
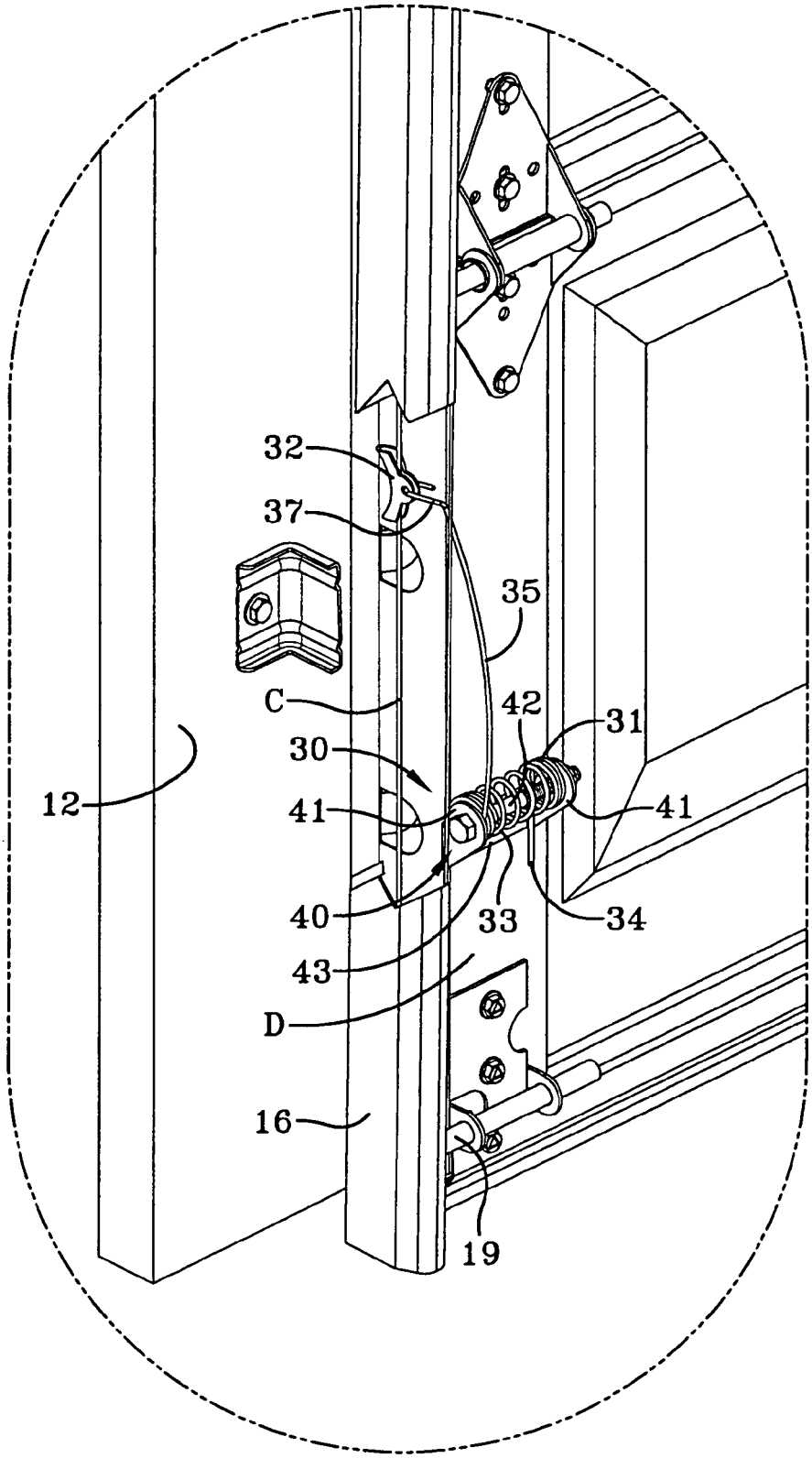
FIG. 2 is an enlarged fragmentary rear perspective view of the lower corner of the door of FIG. 1 depicting further details of the cable tensioner when the door is in a closed position.

With reference to FIGS. 1 and 2, as the door D assumes a closed position, the cable C is paid out from the cable drum 24 and is held taut by the force of the counterbalance spring 22 acting through the axle 21 and cable drums 24. Turning to FIG. 3, as the door D is raised to the open position, force from the counterbalance spring 22 is applied to the door D by cable C to help offset the weight of the door D and allow it to be opened with little effort. To automatically operate the door D, an operator 28, for example, a jack shaft operator as shown, may be provided and may interact with the counterbalance assembly 20 in a manner well know in the art to raise and lower the door D. As the door D is raised, the cable C is wound on the cable drum 24 forming successive cable wraps 29. To ensure proper winding of the cable C and avoid any slack in either of the cables C that might skew the door D or cause the door D to bind, tension must be maintained on the cables C throughout the winding and unwinding process.

To that end, a cable tensioner, generally indicated by the numeral 30 in the drawings, is provided. With reference to FIG. 2, the cable tensioner 30 generally includes a tension spring 31, which may be a coil spring, as shown, and a clip 32 that couples the tension spring 31 to the cable C. In the example shown, tension spring 31 has a coiled body 33, a first end 34 that engages the door D, and a second end 35 that attaches to the clip 32. As shown, the second end 35 of tension spring 31 may be relatively long in comparison to the first end 34 to constitute a wand-like member. It will be appreciated that the length of the second end 35 may be adjusted to take up a selected amount of slack within the cable C. It is preferable that the second end 35 have a degree of flexibility, such that the second end 35 may bend to maintain the cable C in proper alignment with the cable drum 24 as successive cable wraps 29 are formed around the cable drum 24 and to cushion the take-up and release of excess cable when that occurs. The length and thickness of the second end 35 may be used to create sufficient flexibility for this task or an otherwise rigid second end 35 may be provided with a suitably flexible attachment (not shown).

Aside from maintaining alignment of the cable C as it is wound, the length of the second end 35 may be limited by other operating conditions. For instance, in a sectional door D, as shown in the drawings, the height of a door section 36 on which the cable tensioner 30 is mounted may limit the length of the second end 35 as the second end 35 might interfere with the movement of the door section 36, as by contacting a roller 19, as it travels through the transition section 18 of the track assembly 15. While the length of second end 35 will vary depending on the type of door D used, in the example shown, a second end length of approximately one half the height H of the door section 36 was found to be suitable.

The cable tensioner 30 may be mounted on a bracket, generally indicated by the numeral 40, which may, in the example of a coil spring, include a pair of tabs 41 spaced sufficiently to receive the tension spring 31 therebetween. A shaft 42, which may be formed by a bolt, as shown, extends between the tabs 41 and may pass through the body 33 of the tension spring 31 to secure the tension spring 31 to the tabs 41. Tabs 41 are, in turn, secured to the door D as by a crosspiece 43 that is mounted flush against the door D as by screws (not shown).

Figure 6:
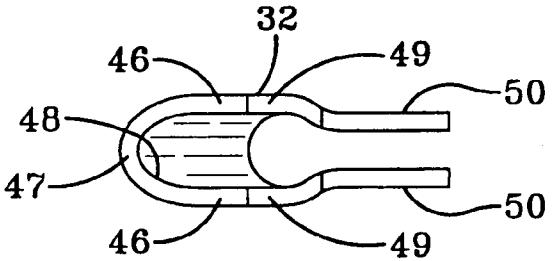
FIG. 6 is an enlarged top plan view of the tensioner clip of FIG. 5.
Figure 7:
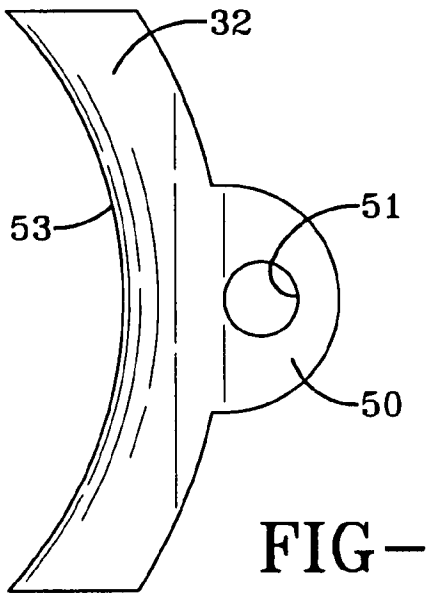
FIG. 7 is an enlarged left side elevational view of the tensioner clip of FIG. 5.
Figure 5:
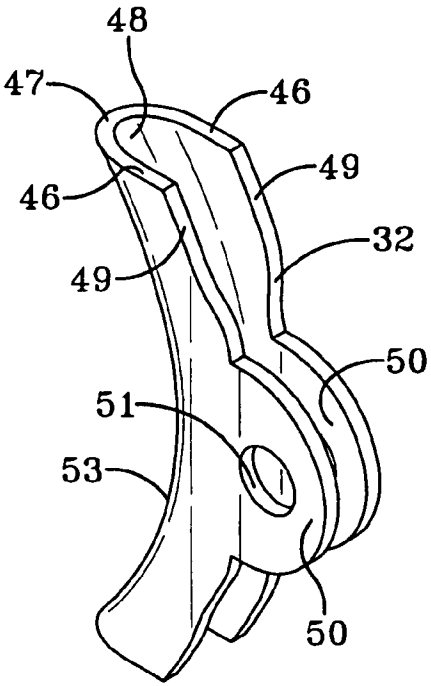
FIG. 5 is an enlarged perspective view of a tensioner clip for interconnecting the tensioner and the cable according to the concepts of the present invention.

With reference to FIGS. 5-7, the clip 32 includes a pair of walls 46 that may be connected at a first end 47 and open at a second end 49 to form a U-shaped channel 48. To facilitate attachment of the clip 32 to the second end 35 of spring 31, a pair of dog ears 50 may extend outwardly from the second ends 49. As depicted in FIG. 7, the dog ears 50 may extend from the center of the walls 46 in parallel fashion, such that the dog ears 50 are laterally spaced from each other. To help hold the clip 32 on the cable C, the dog ears 50 may initially extend inward to at least narrow the gap between the dog ears 50 and neck over the channel 48 to reduce the likelihood of the clip 32 falling from the cable C. To that end, the dog ears 50 may be somewhat flexible to allow the cable C to at least initially be forced through the gap between the dog ears 50 and into the channel 48. After the cable C passes, the flexible dog ears 50 retract to close the cable C within the channel 48.

In the example shown in the drawings, dog ears 50 each define an opening 51 through which the second end 35 of spring 31 may pass in securing the second end 35 of spring 31 to the clip 32. For example, as shown in FIG. 2, the hook 37 of second end 35 may pass through the openings 51 and then bend back upon the second end 35 to secure the clip 32 to the second end 35 of spring 31 during operation. The cable C fits within the channel 48 between the second end 35 of tension spring 31 and the first end 47 of the clip 32. A channel 48 defined by the clip 32 is sufficiently sized to allow the clip 32 to slide along the cable C as necessary as the cable tensioner 30 moves with the door section 36. As best depicted in FIG. 7, the channel 48 may be curved within the plane of the cable C, giving the lower surface 53 of the clip 32, a generally semi-circular profile. While the clip 32 is sliding on cable C, the curved configuration of clip 32 allows the clip 32 and cable C allowing the clip 32 to slide more freely and thus reduce the wear on the cable C. As best shown in FIG. 4, when the clip 32 engages the cable C to take up slack, the curved channel 48 enlarges the contact area of the clip 32 with the cable C to apply the force of spring 31 over a substantial area of the cable at all times.

Figure 8:
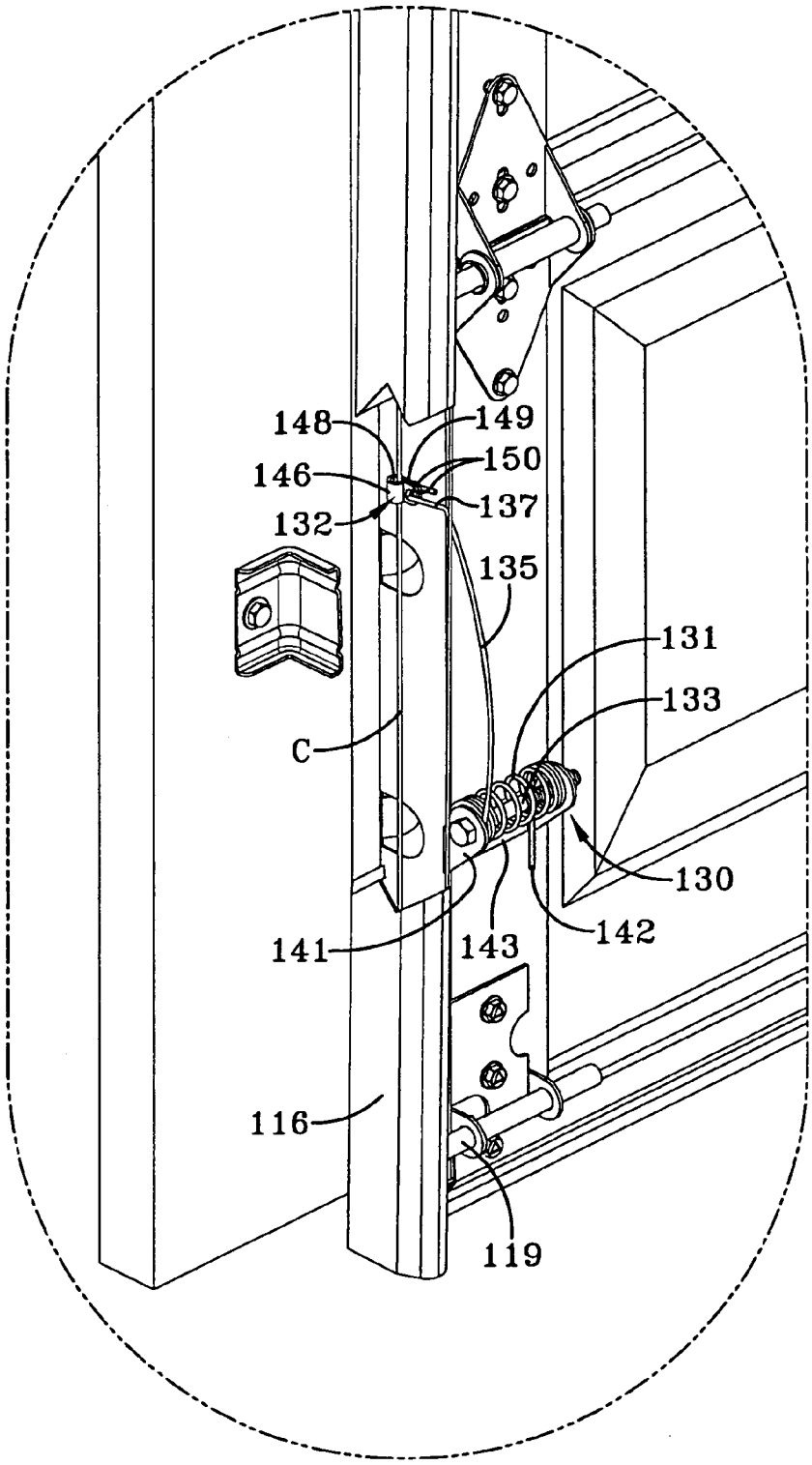
FIG. 8 is an enlarged rear perspective view similar to FIG. 2, depicting a cable tensioner according to the concepts of the present invention with an alternate tensioner clip and showing the door in a closed position.
Figure 9:
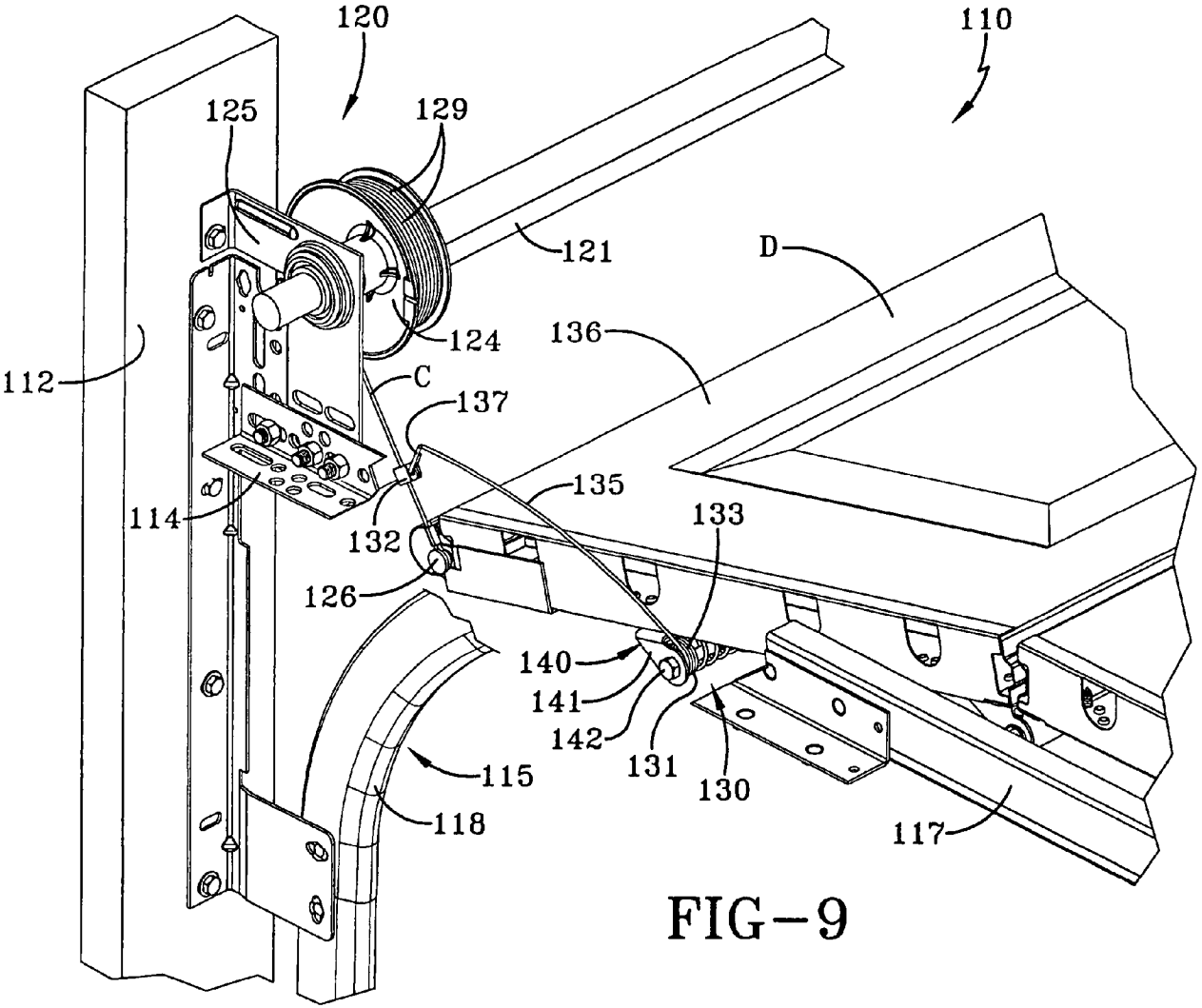
FIG. 9 is an enlarged rear perspective view similar to FIG. 3, depicting a cable tensioner having the alternate clip depicted in FIG. 8 and showing the door in an open position.

It will be appreciated, however, that a less elaborate clip may be suitable for connecting the second end 35 of spring 31 to the cable C. In an alternate embodiment depicted in FIGS. 8 and 9, an alternative clip 132 is shown. Since the alternate embodiment, depicted in FIGS. 8 and 9, shares similar components with the embodiment depicted in FIGS. 1-7, like numerals will be used to refer to like components. As in the previous embodiment, the clip 132 attaches to the second end 135 of the tension spring 131. In this example, the clip 132 defines a generally circular channel 148 through which the cable C passes. The second ends 149 are brought into close proximity to each other with the dog ears 150 extending outward therefrom in very close parallel relationship, such that the dog ears 150 are in contact with each other. As in the previous embodiment, the second end 135 may pass through openings 151 formed in the dog ears 150. Like the previous embodiment, the channel 148 is sized larger than the cable C, such that the clip 132 may slide along the cable C during operation of the door D. As best shown in FIG. 9, as the door D is operated, the clip 132 maintains its contact with the cable C to provide the necessary tension to the cable C if any slack is formed. Otherwise, the tension on the cable C created by the counterbalance spring 22 offsets the force created by the cable tensioner 130, such that the cable tensioner 130 does not cause any deflection of the cable C that might cause damage to the cable C or binding of the door D.

With reference to FIGS. 2-4, operation of the cable tensioner 30 will now be described. The alternate cable tensioner 130, depicted in FIGS. 8 and 9, operates in a similar fashion as cable tensioner 30, and thus this description will apply to both embodiments. Any distinctions between the two embodiments will be noted herein.

Starting with the door D in a closed position (FIG. 2), the cable tensioner 30 is shown with the cable clip 32 in contact with the cable C and attached to the second end 35 of the tension spring 31. The tension spring 31 applies a tension to the cable C by contact of the clip 32 on the cable C. In the position shown in FIGS. 2, it may be seen that the tension on the cable C, generated by the counterbalance spring 22, maintains the cable C in a taut condition without any slack. This tension in the cable C also overcomes any tension created by the tension spring 31 and thus, the cable clip 32 is held in an upright position.

Similarly, as the door D reaches an open position (FIG. 3), tension within the cable C may operate to hold the second end 35 of tension spring 31 and cause it to rotate relative to the position shown in FIG. 2. As can be seen by comparing FIGS. 2 and 3, the second end 35 of tension spring 31 rotates counterclockwise from an upright position, where the second end 35 extends upwardly from the bracket 40 to a rotated position, shown in FIG. 3, where the second end 35 extends downwardly toward the bottom of the door D. It will be appreciated that this rotation occurs gradually as the door section 36, on which the cable tensioner 30 is mounted, moves through the transition section 18 of track assembly 15.

In the event that slack is created in the cable C, as shown in FIG. 4, the second end 35 of the cable tensioner 30 may be urged outwardly by tension spring 31, relative to the cable drum 24, to take up any slack within the cable C. In the example shown, the second end 35 of spring 31 rotates in a clockwise direction under the urging of the tension spring 31 to draw the slack in cable C outward from the cable drum and maintain the appropriate tension in the cable C and maintains proper alignment axially of cable drum 24. As can be seen from a comparison of FIGS. 3 and 4, the second end 35 rotates in a clockwise direction urging the clip 32 upward relative to the door section 36 toward its uppermost extremity. The degree of clip movement will, of course, be proportional to the amount of slack within the cable C. In the example shown, the cable tensioner 30 may gather up cable equal to four times the length of second end 35 of spring 31.

To reduce the stress on the cable tensioner 30 as it is urged toward the open position (FIG. 3), it may be beneficial to position the cable tensioner 30 closer to the point where the cable C is attached to the door D, for example, near lug 26. In other words, in considering a single panel 36, the cable tensioner 30, 130 is mounted to the side of the panel's midpoint M closest to the cable's point of attachment. In the example shown, the cable tensioner 30, 130 is mounted below the midpoint of panel 36. In this way, the second end 35 undergoes a lesser degree of rotation in moving from the closed position (FIG. 2) to the open position (FIG. 3).

As shown in the depicted embodiments, cable tensioner 30, 130 is mounted on the lowermost panel making it accessible in either the closed (FIG. 2) or open (FIG. 3) positions. Thus, the cable tensioner 30, 130 is easily accessed for installation or maintenance without the need for a step ladder.

The second end 35 of tension spring 31 may be attached in any manner including the clips 32, 132 shown. The clips 32, 132 are preferable in that they are less likely to damage the cable C over extended use. Clips 32, 132 may be constructed of any material including metallic and nonmetallic materials, preferably providing low friction engagement with the cable C to prevent wear and fraying of the cable C.

Thus, it should be evident that the sectional door cable tensioner disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

The invention claimed is:

1. A door system comprising, a sectional door, track assemblies, guide rollers attached to said door and engaging said track assemblies to control movement of said door between a closed substantially vertical position and an open substantially horizontal position, a counterbalance system for said door having a cable connected to said door, a tensioner for said cable mounted on said door, a projecting wand of said tensioner biased to remove any slack in said cable during operation of said door, a clip having a channel for engaging said cable and pivotally mounted on a horizontal portion of said wand to maintain substantially the entirety of said channel in contact with said cable while said tensioner is operating to remove slack in said cable, wherein said horizontal portion of said wand is a hook formed proximate an end of said wand and wherein said channel has a pair of dog ears extending therefrom, each of said dog ears having an opening for receiving said hook.

2. A door system according to claim 1, wherein said clip has an opening for receiving said hook.

3. A door system according to claim 1, wherein said dog ears neck over said channel to enclose said cable in said channel.

4. A door system according to claim 1, wherein said dog ears are flexible and have a gap therebetween to permit said cable to be forced between said dog ears during positioning of said clip on said cable.

5. A door system according to claim 1, wherein said channel is sized larger than said cable extending therethrough to facilitate free sliding engagement with said cable and is curved in the direction of curvature of said cable while said tensioner is operating to remove slack in said cable.

6. A door system according to claim 1, wherein said channel is generally cylindrical and sized larger than said cable extending therethrough to facilitate free sliding engagement with said cable.

7. A door system according to claim 1, wherein said counterbalance system has a cable drum for winding and unwinding said cable and said wand is flexible to maintain proper alignment of wraps of said cable axially of said cable drum during winding and unwinding of said cable from said cable drum during operation of said tensioner to remove slack in said cable.

8. A door system according to claim 1, wherein said clip is constructed of anon-metallic, low friction material to prevent wear and fraying of said cable.

9. A door system comprising, a sectional door, track assemblies, guide rollers attached to said door and engaging said track assemblies to control movement or said door between a closed substantially vertical position and an open substantially horizontal position, a counterbalance system for said door having a cable connected to said door, a tensioner for said cable mounted on said door, and a projecting wand of said tensioner pivotally mounted on said door and biased to remove any slack in said cable during movement of said door, said projecting wand pivotal between a position wherein said projecting wand extends toward the bottom of said door and a position wherein said wand extends toward the top of said door.

10. A door system according to claim 9, wherein said cable is connected to said door at a position between where said tensioner is pivotally mounted on said door and said bottom of said door.

11. A door system according to claim 9, wherein said sectional door has a bottom section and said wand has a length of about one-half of the height of said bottom section of said door, whereby said tensioner can gather up slack in said cable equal to about four times the length of said wand.

12. A door system according to claim 11, wherein said wand is mounted on said bottom section between the midpoint of said bottom section and said bottom of said door.

13. A door system according to claim 12, wherein said cable is connected to said door proximate said bottom of said door.

14. A door system according to claim 9, wherein said wand carries a clip having a channel for engaging said cable pivotally mounted on a horizontal portion of said wand to maintain substantially the entirety of said channel in contact with said cable while said tensioner is operating to remove slack in said tensioner.

* * * * *

UNITED STATES PATENT AND TRADEMARK OFFICE

CERTIFICATE OF CORRECTION

PATENT NO. : 7,635,017 B2
APPLICATION NO. : 11/248979
DATED : December 22, 2009
INVENTOR(S) : Bennett, III, Kornish and Johnston It is certified that error appears in the above-identified patent and that said Letters Patent is hereby corrected as shown below:

In Column 8, line 53 (Claim 8, line 2) the word "anon-metallic" should read --a non-metallic--.

Signed and Sealed this

Second Day of February, 2010

David J. Kappos

David J. Kappos
*Director of the United States Patent and Trademark Office*